US007827721B2

(12) United States Patent
Griffin

(10) Patent No.: US 7,827,721 B2
(45) Date of Patent: Nov. 9, 2010

(54) COLLAPSIBLE FIREARM STOCK ASSEMBLY

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 0 days.

(21) Appl. No.: 12/720,343

(22) Filed: Mar. 9, 2010

(65) Prior Publication Data

US 2010/0212206 A1 Aug. 26, 2010

Related U.S. Application Data

(63) Continuation of application No. 11/116,536, filed on Apr. 28, 2005, now Pat. No. 7,673,412.

(51) Int. Cl.
*F41C 23/04* (2006.01)

(52) U.S. Cl. ..... 42/73; 42/75.03; 42/71.01

(58) Field of Classification Search ..... 42/71.01–74, 42/75.03, 75.04
See application file for complete search history.

(56) References Cited

U.S. PATENT DOCUMENTS

| | | | | | |
|---|---|---|---|---|---|
| 543,138 | A | * | 7/1895 | Murray | 42/71.01 |
| 824,505 | A | * | 6/1906 | Munson | 42/73 |
| 1,027,556 | A | | 5/1912 | Marshall | |
| 2,437,548 | A | * | 3/1948 | Patchett | 42/72 |
| 2,441,487 | A | | 5/1948 | Howard | |
| 3,256,632 | A | * | 6/1966 | Beretta | 42/72 |
| 3,348,328 | A | | 10/1967 | Roy | |
| 3,369,316 | A | | 2/1968 | Miller | |
| 3,618,248 | A | | 11/1971 | Into et al. | |
| 3,798,819 | A | * | 3/1974 | Hillberg | 42/72 |
| 3,817,148 | A | | 6/1974 | Schirneker | |
| 4,271,623 | A | | 6/1981 | Beretta | |
| 4,383,384 | A | | 5/1983 | Fox | |
| 4,501,045 | A | | 2/1985 | Boyer | |
| 4,513,523 | A | * | 4/1985 | Gal | 42/72 |
| 4,691,462 | A | | 9/1987 | Mattarelli | |
| 4,724,576 | A | * | 2/1988 | Tatematsu | 220/763 |
| 4,735,007 | A | | 4/1988 | Gal | |
| 4,766,800 | A | | 8/1988 | Miller et al. | |
| 4,788,785 | A | | 12/1988 | White | |
| 5,209,215 | A | | 5/1993 | Morrison | |
| 5,761,842 | A | * | 6/1998 | Mantymaa | 42/71.02 |
| 6,470,617 | B1 | * | 10/2002 | Gregory et al. | 42/75.04 |

(Continued)

OTHER PUBLICATIONS

M203PI, Applications of the M203PI 40mm Enhanced Grenade Launcher Module (EGLM) System, http://m203pi.com/M203PI-Applications.htm, retrieved Jun. 1, 2009.

*Primary Examiner*—Troy Chambers
(74) *Attorney, Agent, or Firm*—Nawrocki, Rooney & Sivertson, P.A.

(57) ABSTRACT

A collapsible firearm stock system is generally provided and preferably includes a shoulder stock system adapted to receive a buttstock thereon, and a locking linkage having a first linkage portion, a second linkage portion, and a hinge pin operatively uniting the first and said second linkage portions. One of the linkage portions is carried by the shoulder stock assembly so as to define a terminal end therefore, the other of the linkage portions being adapted to be carried by a firearm. Each of the linkage portions are adapted so as to automatically unite in locking engagement upon axial alignment of the shoulder stock assembly with the firearm about the hinge pin.

11 Claims, 10 Drawing Sheets

U.S. PATENT DOCUMENTS

| | | | | |
|---|---|---|---|---|
| 6,591,533 | B2 | 7/2003 | Wygant | |
| 6,901,691 | B1 | 6/2005 | Little | |
| 7,065,914 | B1 * | 6/2006 | Wagner, II | 42/73 |
| 7,162,822 | B1 * | 1/2007 | Heayn et al. | 42/73 |
| 2003/0051385 | A1 * | 3/2003 | Wygant | 42/72 |
| 2003/0140542 | A1 | 7/2003 | Kay | |
| 2005/0268516 | A1 * | 12/2005 | Nelson | 42/73 |

* cited by examiner

COLLAPSIBLE FIREARM STOCK ASSEMBLY

This is a continuation of U.S. patent application Ser. No. 11/116,536 filed Apr. 28, 2005, now U.S. Pat. No. 7,673,412 issued Mar. 9, 2010.

TECHNICAL FIELD

The present invention generally relates to firearms or firearm platforms, more particularly, to a collapsible firearm stock assembly which provides a variety of optional configurations based upon user preferences for same.

BACKGROUND OF THE INVENTION

It is well known to adapt or modify weapons generally, and firearms particularly, as is evidenced by the seemingly infinite number of after-market apparatuses and/or devices available to users in furtherance of improved or enhanced user ergonometrics, and/or functionality. A particularly advantageous feature for a firearm or firearm platform has been, and remains, a variably configurable stock to facilitate firearm grip and handling.

As a threshold matter, there has been a long standing recognition as to the desirability of firearms in which the stock can be collapsed from its ordinary, extended position. For example, the collapsed or compact configuration is useful during storage and transport of such weapons, as well as during the transport of personal carrying same, especially in a close quarters environment. In addition, select tactical situations arise in which firing from the hip (i.e., not from the shoulder) will be advantageous, and even necessary, a collapsed condition for the stock being preferable or essential in such circumstances.

Heretofore, the need for a collapsible stock has been met by a number of arrangements, namely, by incorporation of either a sliding stock, or a folding stock into the firearm or firearm mounting platform. As to the sliding stock, it is selectively locked into one or more rearward positions upon a shoulder stock (i.e., a receiver or receiver extension), for ordinary shoulder engaging use, and is easily unlocked and slid forward (i.e., toward the muzzle end of the firearm) to achieve a substantially collapsed configuration therefore. While the rear surface or butt plate of the sliding buttstock is advantageously oriented in the collapsed position for potential firing comfort, it nonetheless substantially extends rearward from a hand grip of the firearm, a less than optimal configuration.

Heretofore known folding stocks have been characterized by a variety of complex folding mechanisms, comprising, among other things, in combination, levers, palls, sliders, dogs, etc., see e.g., U.S. Pat. No. 4,788,785. Attempts at enhanced collapsing functionality, for instance, the combination of folding and sliding, requires a further degree of configuration complexity, more particularly, provisions for several mechanisms and related hardware, see e.g., U.S. Pat. No. 4,383,384), configurations which greatly detract from a user's immediate focus, the situational circumstance (i.e., event) necessitating collapse or extension of the shoulder stock. General impediments to actuation and maintenance of such collapsing mechanisms is especially exacerbated by the less than ideal environmental conditions (e.g., rain, snow, mud, water, etc.) which a user of such an apparatus commonly finds him/herself.

Further shortcomings of heretofore known designs have been reliability and/or durability, more particularly, predictable, repeated operation. Heretofore known collapsing mechanism, due to among other things, numerous pieces and parts: do not reliably transition between collapsed and extended configurations; are known to jam between such configurations; are further known to unintentionally collapse from an extended configuration; and, still further, are know to have a less than desirable operable life span. Thus, it is advantageous to provide a collapsible firearm stock assembly having a mechanism which permits intuitive actuation between collapsed and extended configurations; is of supremely reliable and durable design; and, is readily and quickly adaptable to a variety of host platforms and/or components (i.e., is of modular design). Furthermore, it is likewise advantageous to provide a collapsible firearm stock assembly having a combination of desirable functionalities, for example, those of folding (i.e., collapsing a shoulder stock relative to the host platform), sliding or telescoping (i.e., collapsing, and selectively positioning a buttstock assembly along the shoulder stock), and aligning (i.e., rotating the shoulder stock relative to the host platform, more particularly, the buttstock, for an optimal user engagement/interface.

SUMMARY OF THE INVENTION

The collapsible firearm stock assembly of the subject invention incorporates a variety of highly desirable and advantageous features typical of firearm or firearm platform stock assemblies, into one integrated system, thusly allowing for a variety of optional configurations. Via special structures of the subject assembly in their interrelationships, folding, sliding, and aligning functionalities are provided, more particularly: a pivoting of a stock of the assembly between a "locked-in" and a "locked-out" configuration; select longitudinal positioning (i.e., telescoping) of a buttstock along the shoulder stock of the assembly; and, select axial positioning (i.e., rotation) of the buttstock assembly such that a user preferred shoulder engaging angle for same is permitted. The subject shoulder stock system is adaptable to a variety of mounting configurations to allow universal integration to/with any firearm or firearm platform where the aforementioned functionality for a shoulder brace would be desirable and/or advantageous.

In a preferred embodiment of the invention, the collapsible firearm stock assembly includes a shoulder stock assembly, and locking hinge extending from an end of a shoulder stock of the shoulder stock assembly. The locking hinge includes a first hinge portion, a second hinge portion, and hinge pin operatively uniting the first and second hinge portions. One of the hinge portions is selectively alignable relative to the other of the hinge portions so as to permit rotation of the shoulder stock assembly between a locked-in locking hinge configuration, and a locked-out locking hinge configuration. The hinge portions are registerable, more particularly, capable of self-registration so as to form an interference fit therebetween. The interference fit prohibits rotation of one of the locking hinge portions about the hinge pin, the locked-in and locked-out locking hinge configurations being characterized by the interference fit.

The hinge is especially designed such that the hinge portions automatically form the interference fit due to an internal spring pressure exerted only when the portions "reach" a 0° (i.e., collapsed), or 180° (i.e., extended) condition or configuration. The locking hinge will stay locked, especially in the full-extension position, against strong forces from virtually any direction, making it an ideal brace for a firearm design to be fired by a person from a shoulder supported position. In the collapsed or closed configuration, the locking hinge is designed to maintain a moderate internal pressure on its components, thus requiring the user to make a firm, focused effort to open the hinge by pulling or jerking either the firearm/firearm mounting platform, or the shoulder stock/buttstock attached to the shoulder stock assembly. This feature prevents the locking hinge from opening freely when undesired by the user. Once the initial, moderate resistance to opening is overcome, the remainder of the opening movement is smooth and unhindered in furtherance of achieving a fully deployed 180° auto-locking configuration for the hinge portions.

With regard to the locked-out locking hinge configuration, one of the hinge portions includes a surface adapted to matingly engage a surface of the other of the hinge portions, said mating engagement contributing to the locked-out locking hinge configuration. More particularly, the surface of one of the hinge portions includes a latch, the surface of the other of the hinge portions preferably including a latch receiving structure. Upon alignment of the latch relative to the latch receiving structure (i.e., as the shoulder stock assembly proceeds from a collapsed 0° configuration to a fully extended 180° extension), the latch and latch receiving structure register, and automatically unite due to the interference fit between the hinge portions.

As to further features of the subject invention, the shoulder stock assembly further, and preferably, includes a rib which is reversible affixable to the shoulder stock of the shoulder stock assembly. The rib includes a keyway adapted to selectively secure a buttstock thereto. Furthermore, the shoulder stock assembly is axially positionable relative to the locking hinge, the butt plate of the buttstock being easily and selectively alignable from a traditional vertical orientation (i.e., up and down, as, for instance, the hand grip of the firearm platform) to one that is tilted or otherwise angled (i.e., in a rear plan view, the butt plate is positionable so as to extend beyond a traditional 6/12 o'clock position, for instance, may be aligned anywhere between the traditional 6/12 and an 12/6 o'clock position). More specific features and advantages obtained in view of those features will become apparent with reference to the drawing figures and DETAILED DESCRIPTION OF THE INVENTION.

BRIEF DESCRIPTION OF THE DRAWINGS

Referring now to the drawings wherein like numerals are used to designate like parts of the invention throughout the figures.

DETAILED DESCRIPTION OF THE INVENTION

As a preliminary matter, the collapsible stock assembly of the subject invention, provides, vis-a-vis its elements and their interrelationships: a folding functionality, namely, pivoting of a stock of the assembly, relative to a firearm receiver, between a "locked-in" (i.e., collapsed) and a "locked-out" (i.e., extended) configuration; a sliding or telescoping functionality, namely, select longitudinal positioning of a buttstock assembly along a shoulder stock of the collapsible stock assembly; and, an aligning functionality, namely, select axial positioning (i.e., rotation) of the buttstock assembly, relative to a firearm barrel, such that a user preferred shoulder engaging angle for same is achievable.

The folding functionality (i.e., pivoting) of the subject collapsible stock assembly is readily appreciated, and will subsequently detailed, with specific reference to FIGS. 2-9, whereas the telescoping and aligning functionality of same is readily appreciated, and will subsequently detailed, with reference to FIG. 10. The locked-in and locked-out configurations for the subject collapsible stock assembly are illustrated in FIGS. 1 & 10 respectively.

Figure 1:
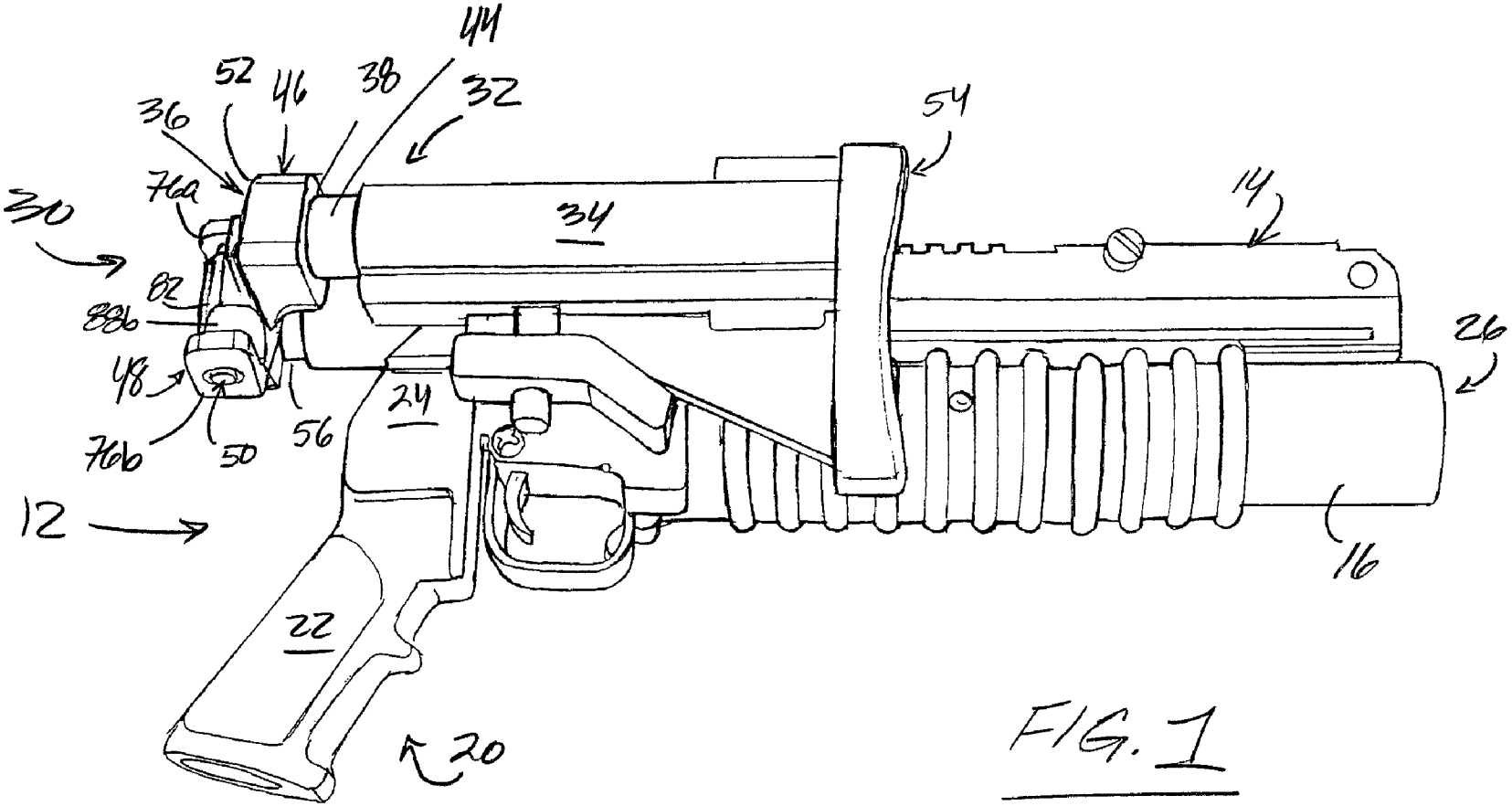
FIG. 1 illustrates a perspective view of a firearm fitted with the collapsible stock assembly of the subject invention, a shoulder stock assembly thereof in a collapsed, locked-in configuration.

Referring now to FIG. 1, there is generally shown a firearm 12, more particularly an M203 grenade launcher, broadly comprising a receiver 14, a barrel 16 operatively united to the receiver 14 so as to preferably, but not necessarily, extend beyond a free end thereof, and a collapsible stock assembly 30, operatively united to the receiver 14, opposite the free end thereof. As previously noted, the collapsible stock assembly 20 is illustrated in a collapsed, locked-in configuration or condition.

In furtherance of subsequent discussion and clarity, the receiver 14 is likely, as is the case with regard to FIG. 1, but not necessarily, integral to, or a component of, the firearm 12 or a host platform. Such platforms, which are well know in the weapon hosting art, may further and generally include, as shown in FIG. 1, a grip 20 having a hand hold 22 downwardly extending from a head 24. It is to be understood that the firearm of FIG. 1 is representative of the numerous firearms, and/or firearm platforms, known to be available, and thus, is in no way limiting to the practice of the subject invention, known firearms/firearm platforms being easily and readily adaptable by those of ordinary skill in the art so as to operatively receive the subject collapsible stock assembly.

Figure 10:
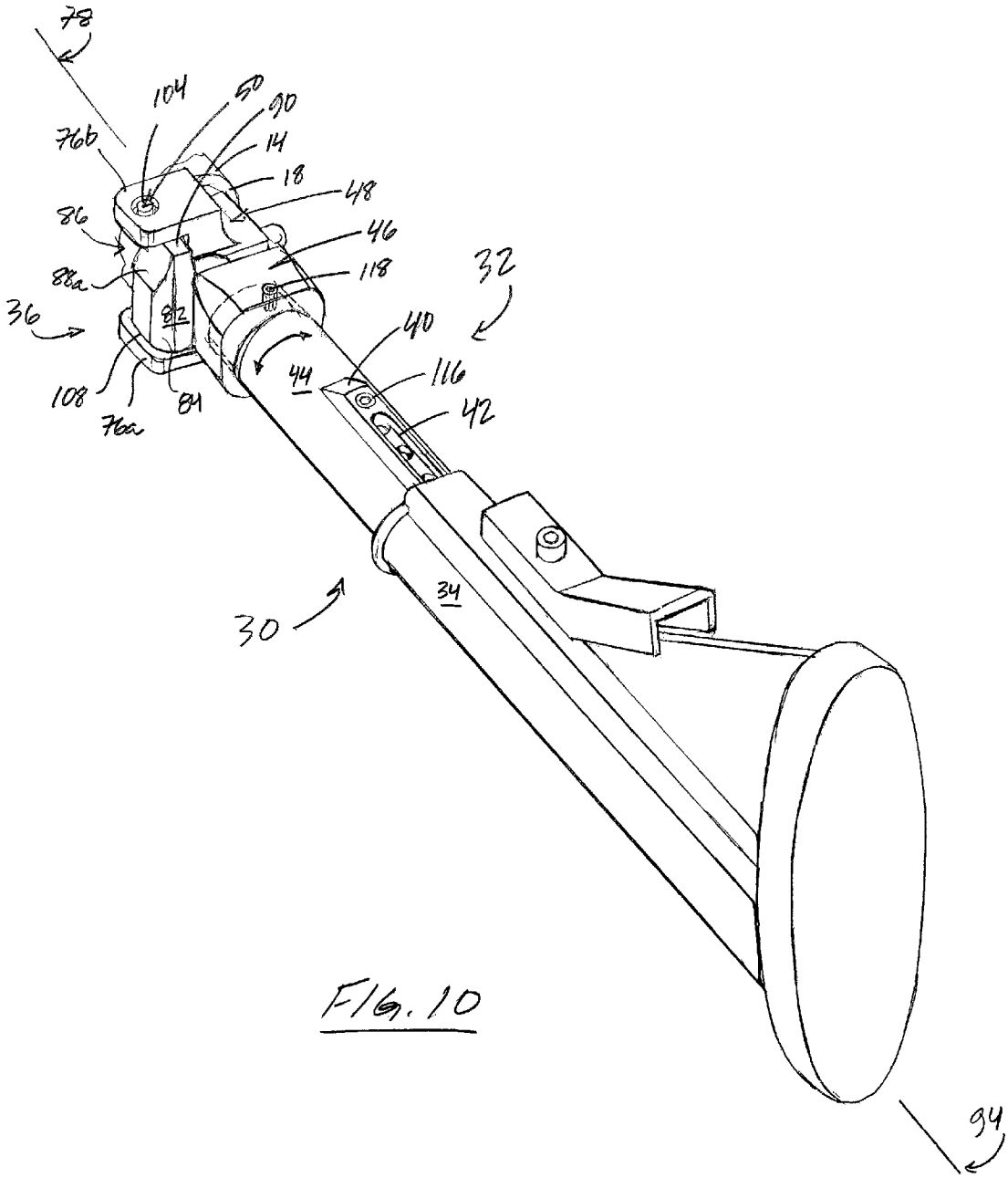

With general reference now to FIGS. 1 & 10, the subject collapsible stock assembly 30 generally includes a shoulder stock assembly 32 (e.g., a rail or rail assembly) adapted to receive a buttstock/buttstock assembly 34, and a locking linkage or hinge 36 extending from a free end 38 thereof. The shoulder stock assembly 32 of the collapsible stock assembly 30 is further, and preferably adapted to receive a rib 40 having a keyway 42 (i.e., a select rib from a variety of ribs having keyways of known configurations and/or dimensions), FIG. 10, for receipt of the buttstock/buttstock assembly 34 in furtherance of select positioning of the buttstock therealong. More particularly, the rib 40 is reversibly and selectively securable to a shoulder stock 44 of the shoulder stock assembly 32.

Figure 2:
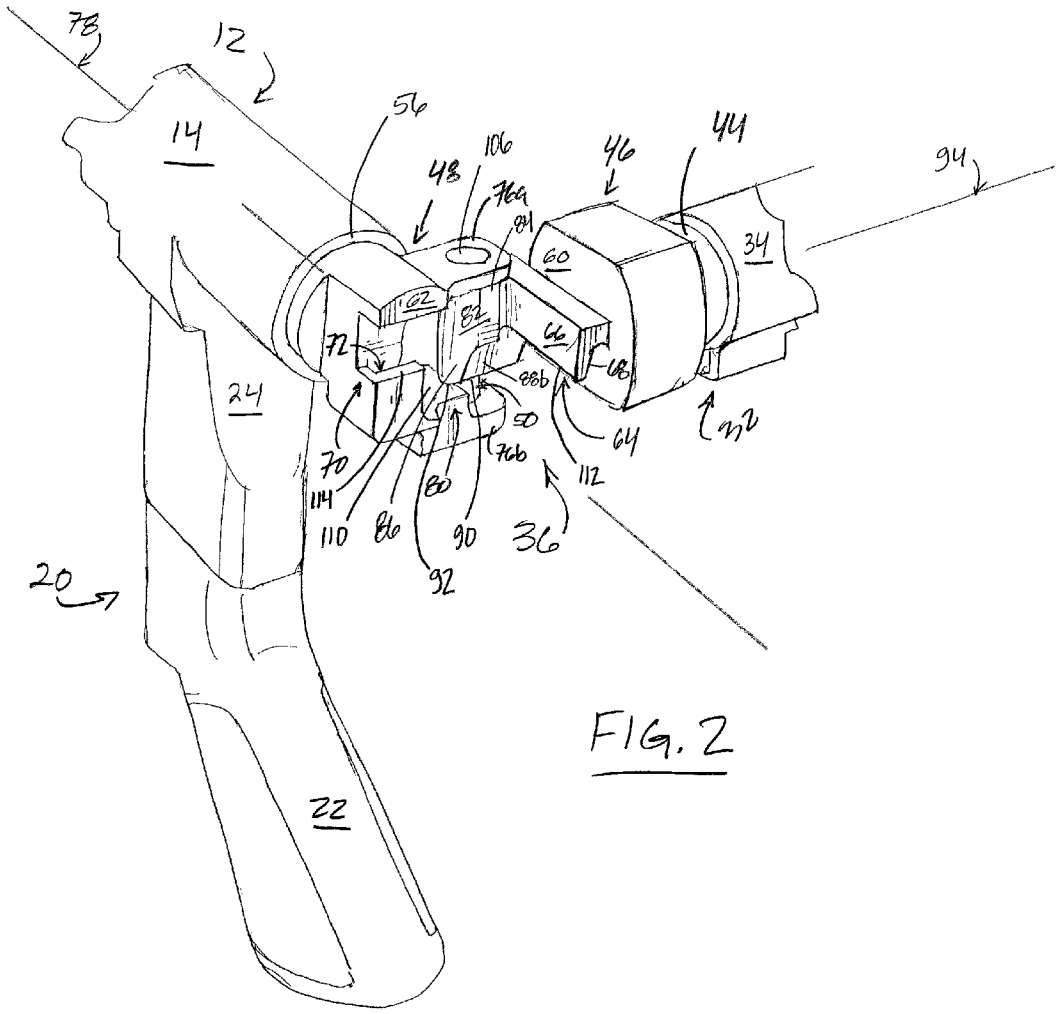
FIG. 2 illustrates a perspective view of locking hinge portions of the subject invention from above, more particularly, one of the hinge portions, and shoulder stock assembly, positioned about 45 degrees from the locked-in configuration of FIG. 1, the one hinge portion free to rotate about a hinge pin.
Figure 8:
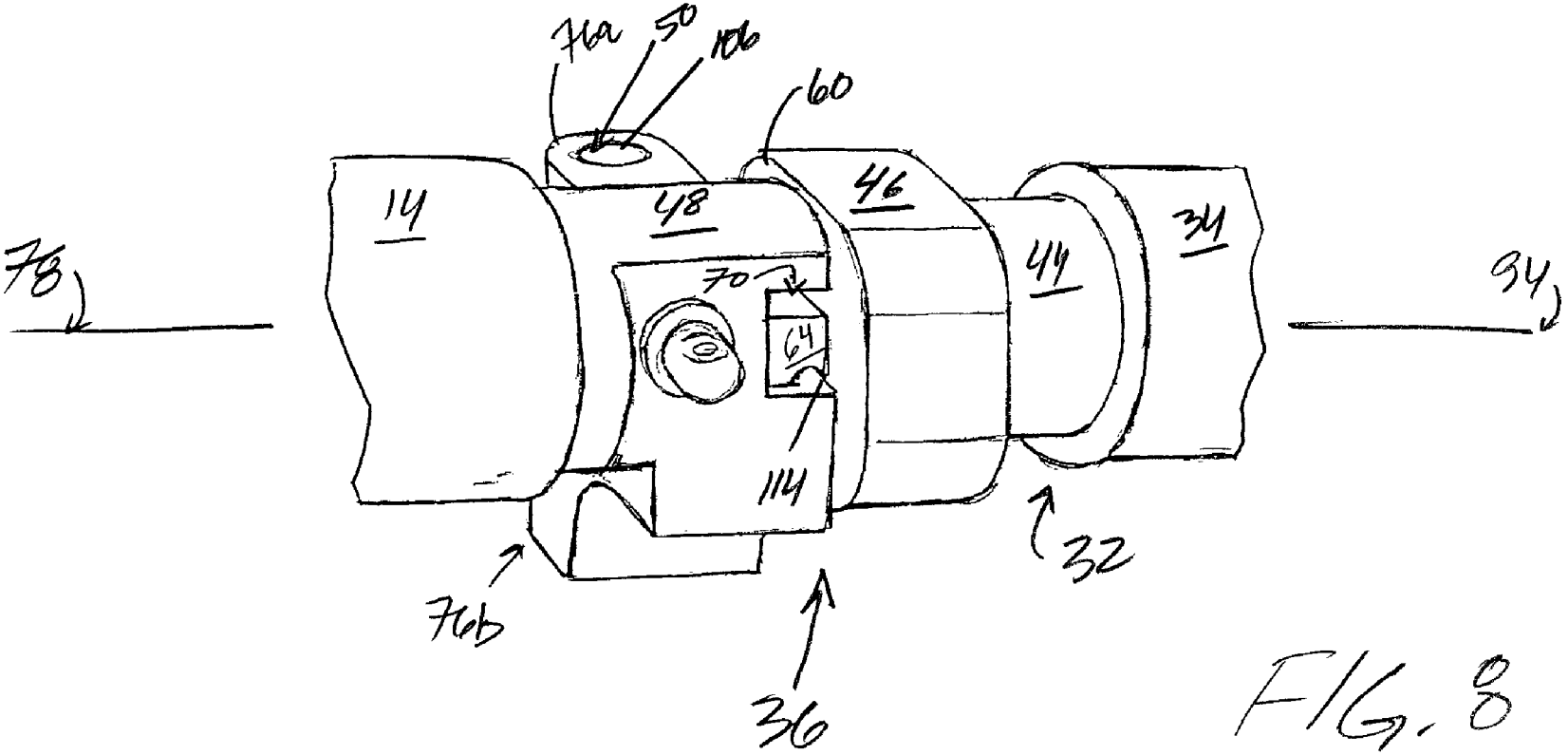
FIG. 8 illustrates the engagement (i.e., integration) of the aligned latching structures of FIG. 7.
Figure 9:
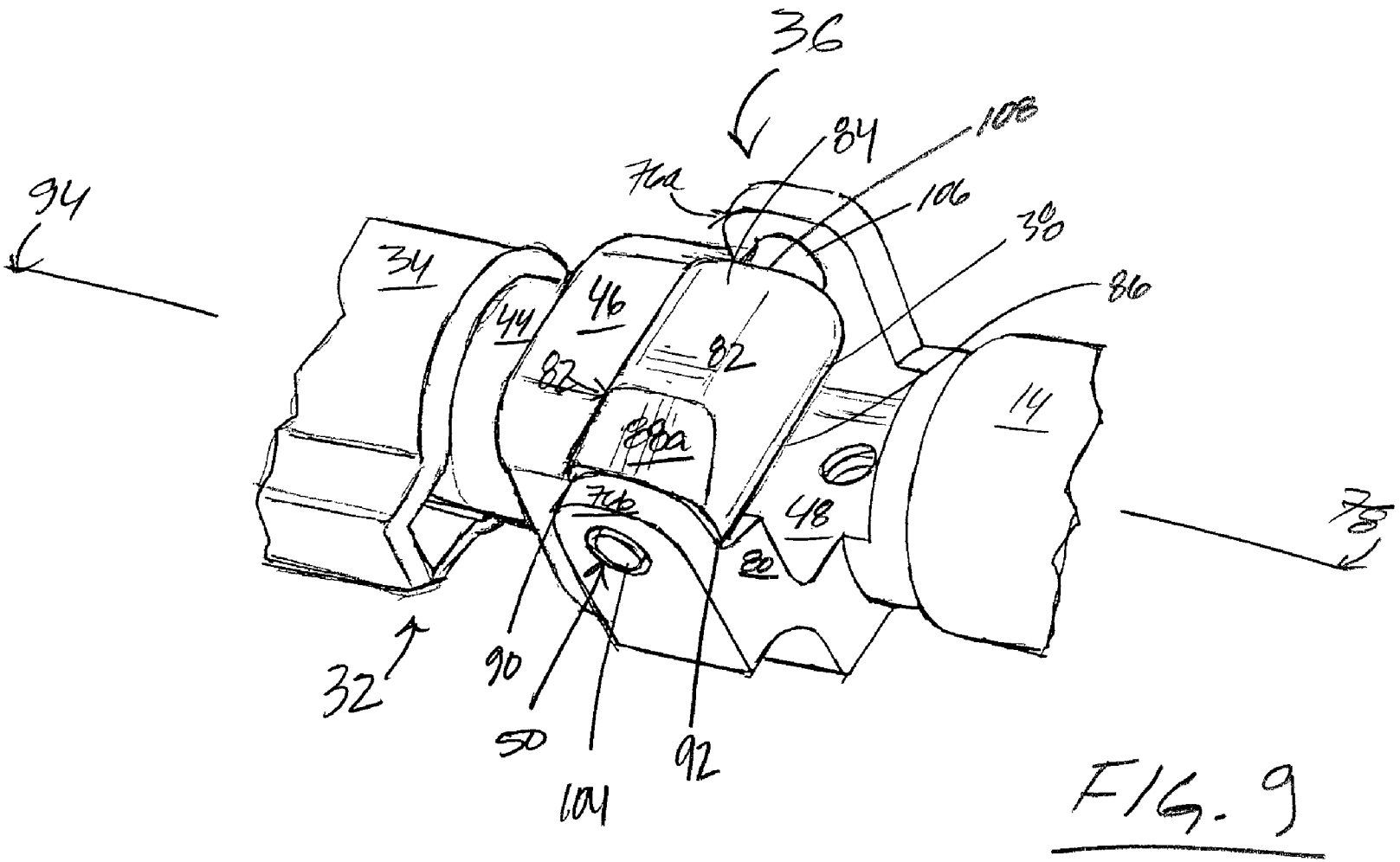
FIG. 9 illustrates a view opposite that of FIG. 8, showing an interference fit between/for the locking hinge portions, more particularly, a biased extension of one locking hinge portion relative to the other so as to prevent rotation of the one portion about the hinge pin; and, FIG. 10 illustrates a perspective view of the underside of the locked-out or deployed assembly configuration, a buttstock assembly shown in telescoped extension.

Referring now generally to FIGS. 1 & 2, the locking hinge or joint 36 of the assembly 30 generally includes a first hinge portion 46, a second hinge 48 portion, and a hinge pin 50 operatively uniting the first 46 and second 48 hinge portions. One of the hinge portions is selectively alignable, as will later be detailed, relative to the other of the hinge portions so as to permit rotation of the shoulder stock assembly 32 between a locked-in locking hinge configuration (FIG. 1), and a locked-out locking hinge configuration (FIGS. 8-10). More particularly, the hinge portions 46, 48 are registerable so as to form an interference fit therebetween, and more particularly still, the hinge portions 46, 48 self-register so as to form an interference fit therebetween. The interface fit prohibits rotation of one of said locking hinge portions about the hinge pin 50, both the locked-in and locked-out locking hinge configurations characterized by the interference fit of the locking hinge portions 46, 48. In addition to the interference fit between locking hinge portions, the portions 46, 48 are designed to latchingly mate in the locked-out locking hinge configuration, more particularly, one of the locking hinge portions includes a surface adapted to matingly engage a surface of the other of the hinge portions, as will subsequently be detailed.

By way of further general disclosure, one of the hinge or linkage portions is adapted so as to be carried by the stock 44 of the shoulder stock assembly 32 (e.g., first linkage portion 46), and thereby define a terminal end 52 therefore (i.e., an end opposite a butt end 54 of the buttstock 34 of the subject assembly 30), the other of the linkage portions (e.g., second linkage portion 48) is adapted so as to be carried by the receiver 14 of the firearm 12 and thereby define a terminal end 56 therefore (i.e., an end opposite the free or muzzle end 26 of the firearm).

It should be readily appreciated that the convention of "first" and "second," as related to the linkage portions 46, 48 and other structural elements, as the case may be, has been arbitrarily adopted to facilitate discussion. Furthermore, it is to be understood that the linkage portions 46, 48 are capable of being interchanged in the context of the assembly/firearm (i.e., in relation to the components thereof) while nonetheless retaining the commensurate advantage of the linkage generally (i.e., the "first" linkage portion 46 may be readily adapted to extend from receiver 14 of the firearm 12, the "second" linkage portion 48 being readily adapted to extend from the stock 44 of the shoulder stock assembly 32). Finally, it is further contemplated that the linkage 36 may be oriented, in the context of the assembly/firearm, such that a top/bottom versus side/side (FIG. 1) collapsed relationship exists between the stock assembly 32 and firearm receiver 14/barrel 16 (i.e., the linkage, as shown in FIG. 2, may, to the extent it is advantageous or desirable to do so, be rotated 90 degrees counter-clockwise in the assembly or system 30 relative to the firearm receiver 14).

With regard to support of the linkage portions 46, 48 by either the firearm 12 (i.e., a host platform) or the shoulder stock (i.e., a host platform extension), a variety of interfaces are contemplated. For example, a linkage portion may include an internally or externally threaded element, or a plug of unlimited geometric configuration for receipt by the host platform, the plug being aligned, or at least retained, via a removable pin, set screw, or other mechanism as the situation (e.g., compatibility) dictates. It should be readily appreciated that an unprecedented variety of host platforms may be accommodated, the subject collapsible stock assembly being suitably mated with multiple host platforms by removing only the hinge pin 50 and adapting the second linkage portion 48 so as to be received thereby. Furthermore, adaptors may be made to fit the host platform which thread onto a threaded, indexed linkage portion, allowing a quick-change of host mating in a variety of positions around the front axis of the hinge or linkage, depending upon where the locating set-screw is indexed. This provides the user with maximum flexibility and value from their investment in the stock assembly or system by offering a great variety of uses by changing only one component thereof as their needs or applications change.

With general reference to FIGS. 2-9, and as to the linkage portions, the first linkage portion 46 generally includes a surface 60 adapted to matingly engage a surface 62 of the second linkage portion 48, more particularly, the surface 60 of the first linkage portion 46 preferably includes a latch 64 or the like, more particularly and preferably, a depending clasp 66 having an angled surface 68. The latch 64 generally extends from the surface 60 of the first linkage portion 46 for receipt by a portion of the surface 62 of the second linkage portion 48 (e.g., a latch receiving structure 70, more particularly and preferably, a clasp well 72 having an angled surface 74 for mating with the angled surface 68 of the clasp 66). It is especially advantageous that the linkage 36 of the subject collapsible stock assembly 30 inherently include a latching and actuation mechanism, more particularly, a mechanism which is intuitively actuatable to reflexively permit extension of the stock of the assembly between locked-in (i.e., collapsed) and locked-out (i.e., deployed extension) configurations or positions.

Figure 4:
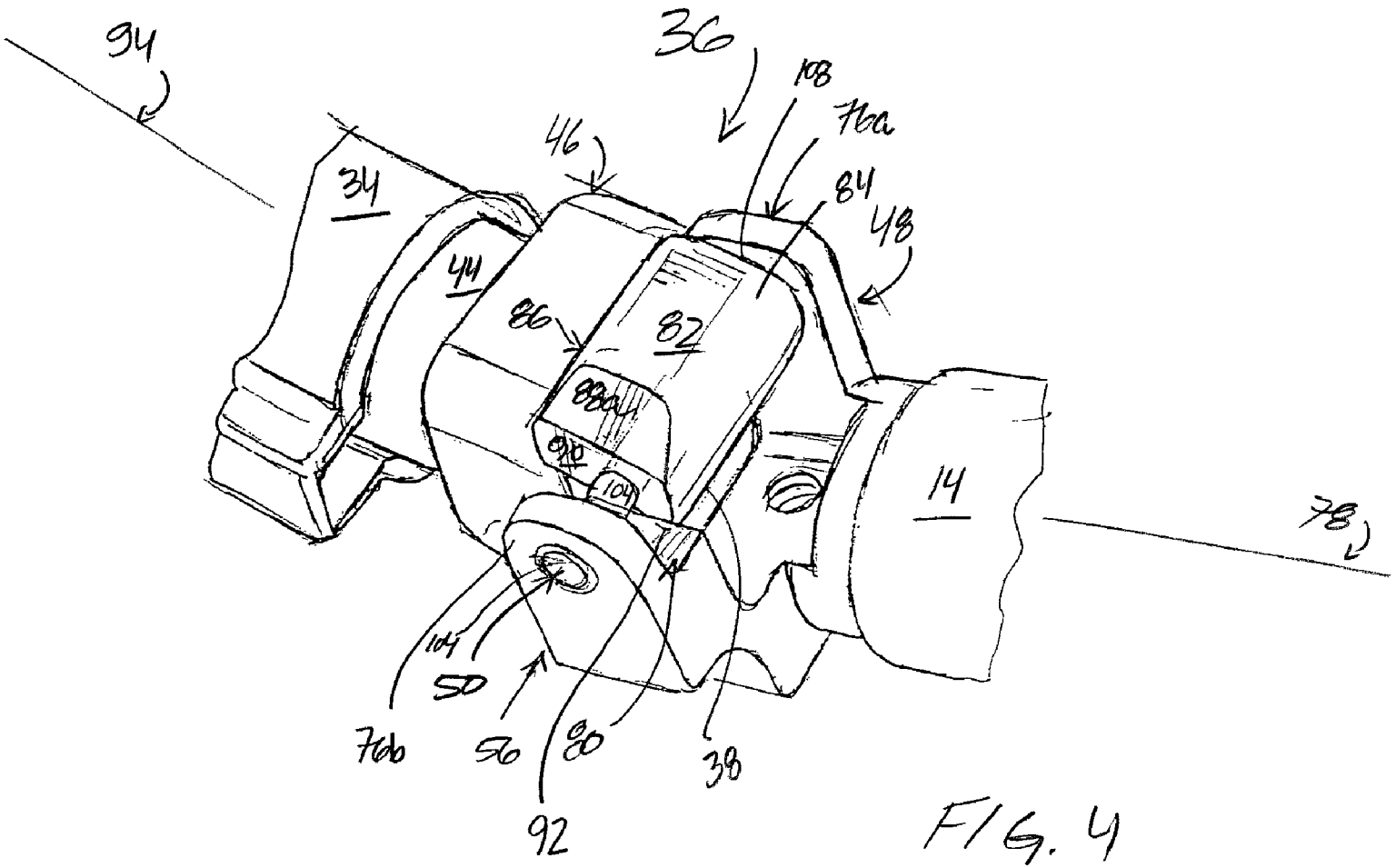
FIG. 4 illustrates a perspective view, diametrically opposite the view of FIG. 3, of the locking hinge portions in a configuration permitting rotation of the one hinge portion about the hinge pin.
Figure 5:
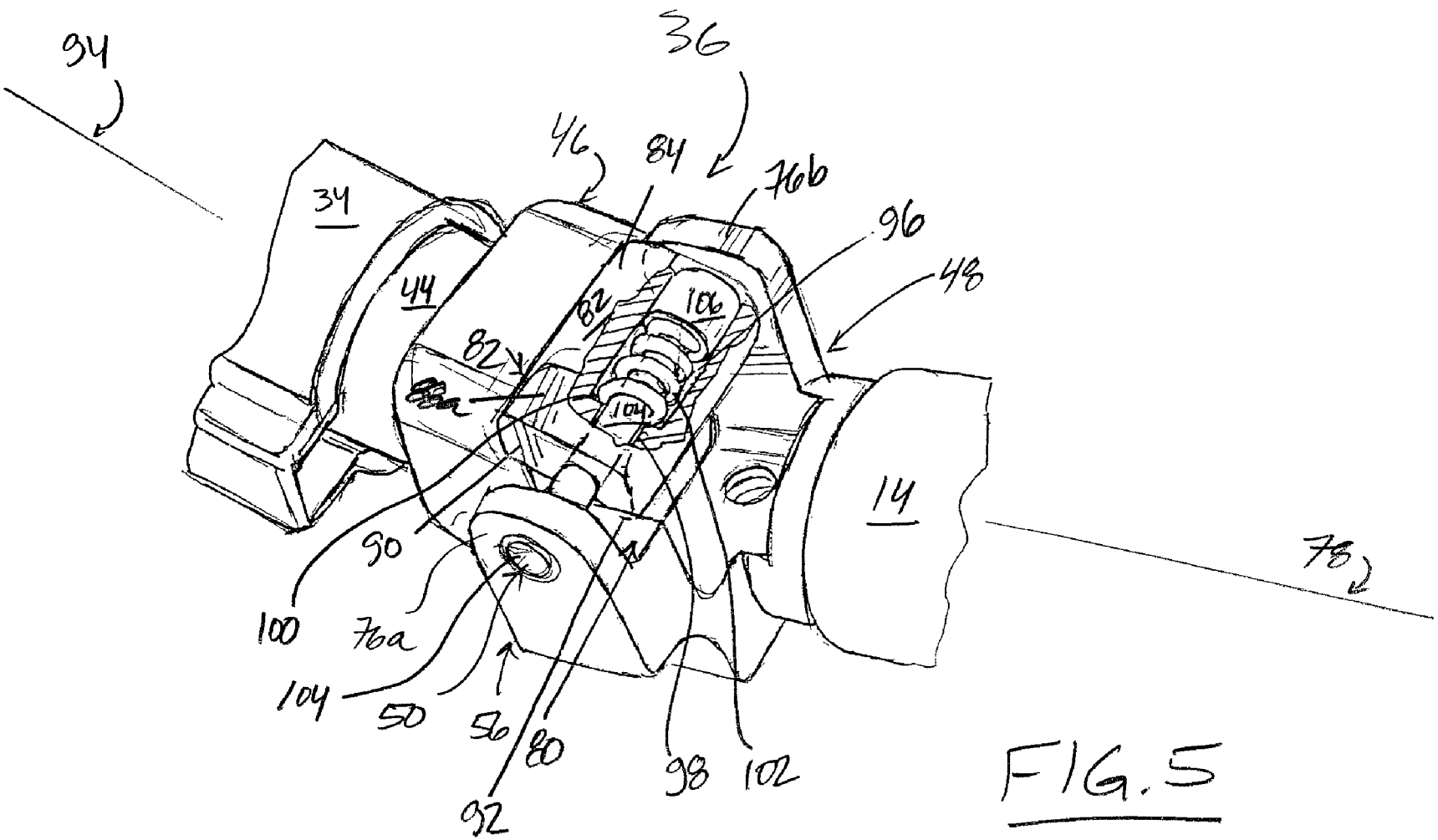
FIG. 5 is a view as FIG. 4, portions broken away to illustrate details of the union of locking hinge portions via the hinge pin, more particularly, illustrating a biased union of the locking hinge portions.
Figure 6:
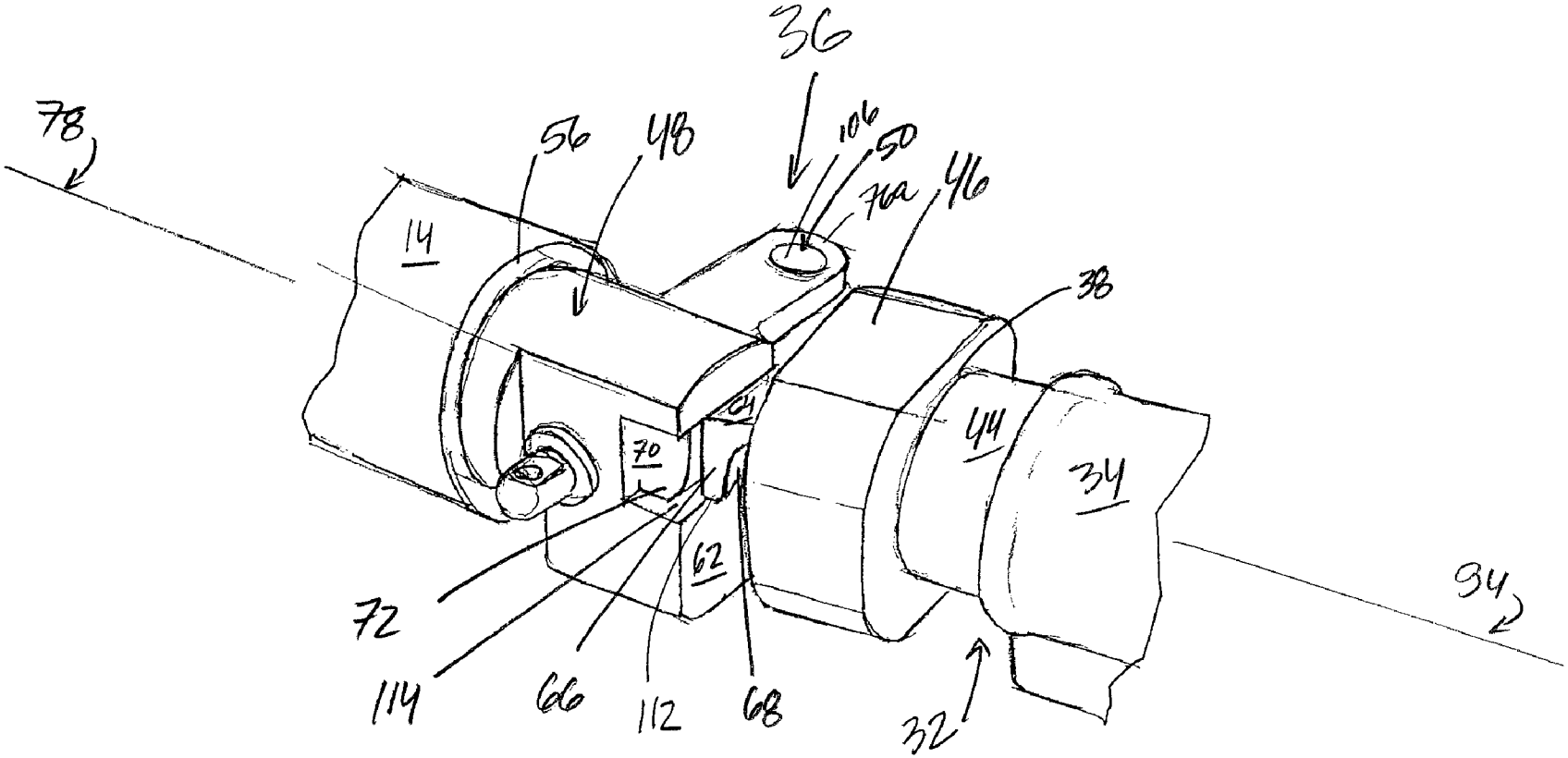
FIG. 6 is a view as FIG. 3, the shoulder stock assembly in a condition of further rotation in furtherance of locking-out same.
Figure 7:
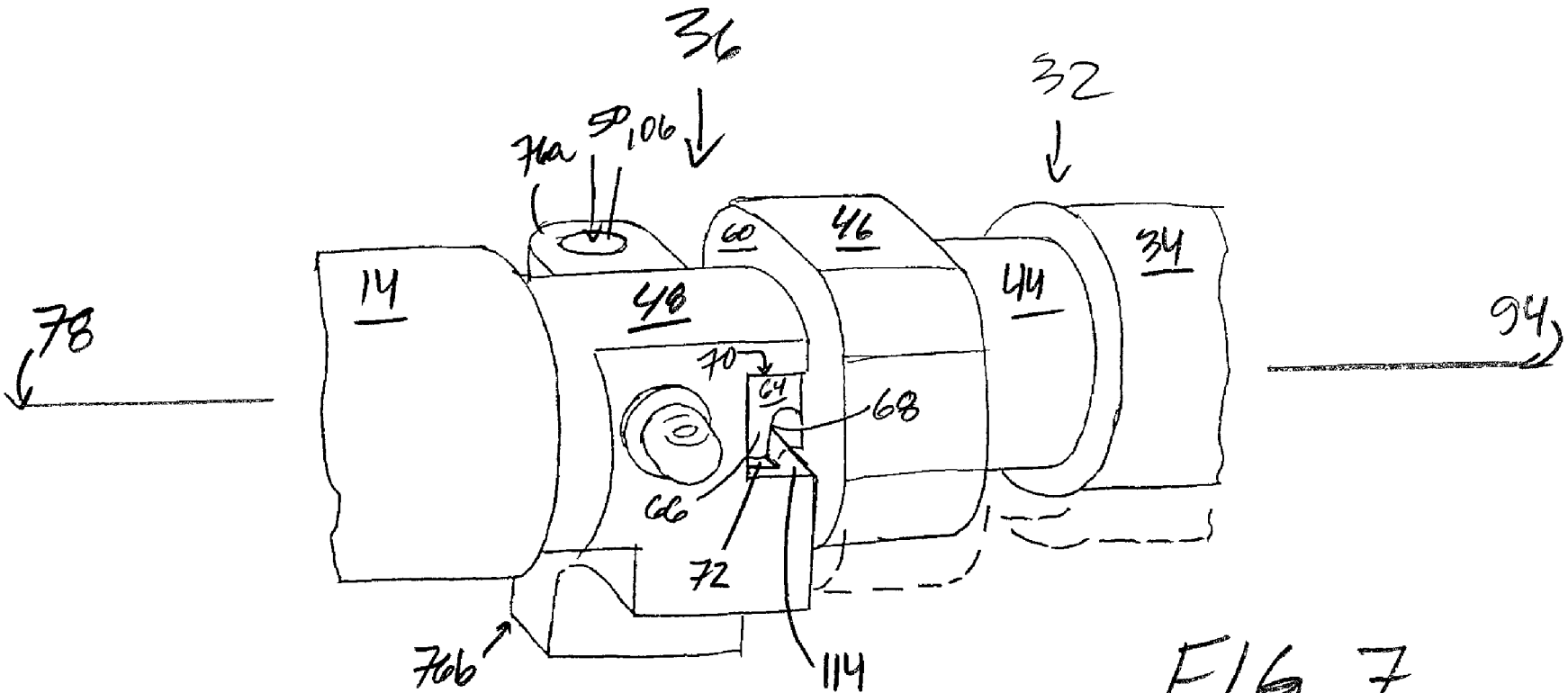
FIG. 7 illustrates a slight perspective view of the locking hinge portions in alignment for automatic locking (i.e., locked-in) engagement, such engagement depicted in dashed lines.

The second linkage portion 48 is generally adapted so as to support the hinge pin 50 about which the shoulder stock assembly 32 pivots. As best seen in FIGS. 2 & 4, the hinge pin 50 is secured between opposingly paired spaced apart flanges 76 (i.e., 76*a* and 76*b*) of the second linkage portion 48, the flanges 76 generally extending so as to be proximal to the latch receiving structure 70, and offset from a longitudinal axis 78 of the firearm receiver 14. In the configuration as illustrated (FIG. 2), the hinge pin 50 is vertically oriented (i.e., substantially parallel with/to the head 24 of the grip 20), and the flanges 76 laterally offset (i.e., laterally extending from the latch receiving structure 70 thereof) so as to permit the side-by-side arrangement of FIG. 1.

The second linkage 48 further includes a stage 80 proximal or adjacent the clasp well 72 so as to lay between the latch receiving structure 70 and that portion of one of the flanges 78 into which the hinge pin 50 is secured (e.g., the "lower" or page bottom flange 78*b* of FIG. 2). The functionality of the stage will be later discussed in relation to actuation of the latching mechanism, more particularly, its relationship to a locking block of the first linkage portion.

The first linkage portion 46 further preferably includes a locking block 82 having upper 84 and lower 86 portions and generally adapted so as to receive the hinge pin 50 therethrough. The lower portion or base 86 of the locking block 82 preferably, but not necessarily, includes opposing wedge or ramp surfaces 88 (i.e., 88*a*/88*b*) which upwardly and outwardly extend from a "bottom" surface 90 of the locking block 82. The bottom surface 90 of the locking block 82 includes a heel 92 which delimits a lower and forward most surface for the lower block portion 86 (FIG. 4). The locking block 82, which generally defines or delimits a forward most structure for the first linkage portion 46, is generally offset from a longitudinal axis 94 of the stock 44, commensurate with the hinge pin supporting flange arrangement (i.e., shown to right of axis 94 in FIG. 2).

The locking block 82 further includes a bore 96 (FIG. 5) therethrough for receipt of the hinge pin 50 therein. The bore 96 preferably includes a reduced diameter portion 98 so as to provide an annular shoulder 100 for seating one end of a compression spring 102 (FIG. 5) coiled about a shank 104 of the hinge pin 50. An opposite end of the spring seats against an enlarged cylindrical head 106 of the hinge pin 50, and continuously urges the locking block 82, and thus the first linkage portion 46 in its entirety, away from the head 106 of the hinge pin 50 (i.e., away from the upper flange 76*a* and towards the lower flange 76*b* of the second linkage portion 48).

The internal spring pressure associated with the subject linkage 36, and select structures of each of the linkage portions 46, 48 and their interrelationships, provide automatic "locked-in" and "locked-out" configurations for the assembly of the subject invention, more particularly, fully extended positions for the locking block 82 (i.e., the first linkage portion 46) at 0° (i.e., collapsed as in FIG. 1), and 180° (i.e., extended as in FIG. 10), respectively. "Unlocking" the locked hinge configuration generally requires a user to translate the locking block 82, directly or indirectly, upon the hinge pin 50 so as to overcome the spring pressure thereon, and disengage previously engaged linkage structures. Having overcome the interference fit of the hinge portions 46, 48, rotation of one portion relative to the other is possible in furtherance of folding the shoulder stock assembly 32. The relationship among and between linkage structures implicated in folding/unfolding the shoulder stock are hereinafter discussed.

As previously noted, the shoulder stock assembly 32 of the subject collapsible stock assembly 30 is shown in FIG. 1 in a collapsed, locked-in configuration, the locking block 82 of the first linkage portion 46 in full biased extension, as is also the case in the extended, locked-out configuration of, for example, FIGS. 8 & 9. As is best seen with respect to FIG. 9, and is further representative of the configuration of FIG. 1, the lower or base portion 86 of the locking block 82, more particularly, the bottom surface 90 thereof, is minimally spaced from the lower flange 76*b* of the second hinge portion 48, the upper portion 84 of the locking block 82, more particularly, a top surface 108 thereof, being maximally spaced from the upper flange 76*a* of the second linkage portion 48. During rotation of one hinge portion about the hinge pin 50, the aforementioned relationships are reversed (see e.g., FIG. 4).

Further characteristic of the locked configurations of the subject firearm stock assembly or system 30 is an abutting relationship or interference fit between the wedge or ramp surfaces 88 of the lower portion 86 of the locking block 82, and the stage 80 interposed between the latch receiving structure 70 and the lower flange 76*b* of the second linkage portion 48. The exterior wedge surface 88*a* (FIG. 4, as opposed to the interior wedge surface 88*b* of FIGS. 2 & 3) critically permits quick unlocking from a moderately secured collapsed condition, a forceful jerk of the shoulder stock assembly 32, more particularly the buttstock 34 thereof, "outward" from the firearm receiver 14 initiates a camming action between abutting hinge portions (i.e., the wedge surface 88*a* and the stage 80) so as to overcome the biased extension of the locking block 82, the absence of the interference fit permitting immediate, unencumbered rotation of the shoulder stock assembly 32 about the hinge pin 50.

Referring now generally to FIGS. 2-6, folding is initiated via translation of the locking block 82 upwardly upon the hinge pin 50, either manually by direct user exertion upon the shoulder stock assembly 32, in furtherance of collapsing the shoulder stock assembly from a locked-out configuration, or, indirectly by user exertion upon the buttstock assembly 34, in furtherance of extending the shoulder stock assembly, as previously discussed, so as to overcome the internal spring pressure, and thusly remove either of the wedge surfaces 88 of the lower portion 86 of the locking block 82, as the case may be, from abutting engagement with the stage 80. With regard to initiating a collapsed folding, the following actions are preferred: grasping of the shoulder stock assembly 32 such that a thumb is generally extended forward thereof for positioning over the hinge pin 50 (i.e., resting upon the upper flange 76*a* of the second hinge portion 48), the remaining digits curled about the shoulder stock 44 with the index finger positioned on the underside of the first hinge portion 46; and, squeezing of the grasping hand via upward motion of all but the thumb so as to overcome the internal spring pressure of the locking block 82 on the hinge pin 50 and thus the interference fit between hinge portions.

Figure 3:
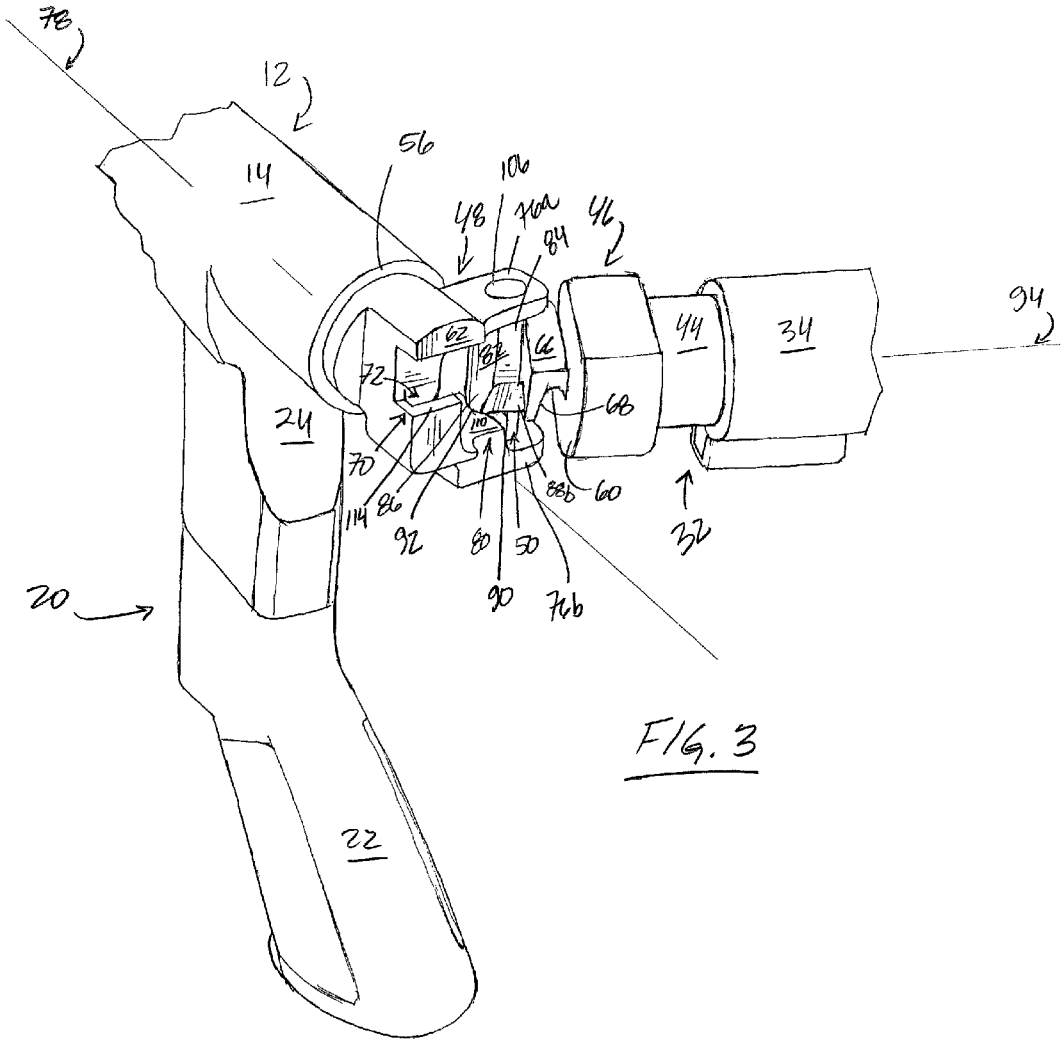
FIG. 3 is a view as FIG. 2, the shoulder stock assembly in a condition of further rotation in furtherance of locking-out same.

Upon unlocking of the hinge 36 and initial rotation, the heel 92 of the lower portion 86 of the locking block 82 is received upon a surface 110 of the stage 80, with continued of further rotation of the locking block 82 being unimpeded through the remainder or balance of the pivot motion in furtherance of locking out the shoulder stock assembly 32. As rotation proceeds from FIG. 6 and approaches 180° (i.e., to full extension, see FIG. 7), the latch 64 of the first linkage portion 46 aligningly approaches the latch receiving structure 70 of the second linkage portion 48 in furtherance of cooperative engagement therewith. More particularly, a sole 112 of the clasp 66 approaches (FIG. 6), and passes over (FIG. 7), a deck 114 of the clasp well 72. With a fully extended, 180° rotation of the shoulder stock portion 32 of the subject assembly 30 about the hinge pin 50, the linkage structures assume the alignment shown in FIG. 7, namely, the clasp 66 of the first linkage portion 46 is aligned directly over the clasp well 72 of the second linkage portion 48. Furthermore, and significantly, in conjunction with said alignment, the heel 92 of the lower portion 86 of the locking block 82 rotates off the stage surface 110, such that the locking block 82 returns (i.e., automatically returns) to a full spring pressure extension (FIG. 9), and thereby reinstates the interference fit between hinge portions 46, 48. As such, a surface opposite the external wedge surface 88*a* of the lower portion 86 of the locking block 82 (FIG. 4), abuttingly engages the stage 80 (FIG. 8), more particularly, but not necessarily, the further wedge surface 88*b* as shown in FIGS. 2 & 3, with the angled surfaces 68, 74 of the clasp 66 and clasp well 72 matingly uniting (FIG. 9) in furtherance of a supremely secure locked-out configuration for the subject collapsible stock assembly.

With regard to the sliding functionality of the subject invention, a well known sliding buttstock assembly 34, as is fully disclosed in U.S. Pat. No. 3,348,328, incorporated herein by reference, is shown in a collapsed or compact condition (FIG. 1), and in an extended condition (FIG. 10), the buttstock assembly 34 being selectively securable to and along the shoulder stock 44 via the rib 40 which is reversibly secured thereto via threaded fasteners 116 or the like. The rib 40, more particularly the keyway 42 thereof, functions first to keep the sliding buttstock assembly 34 properly aligned to the shoulder stock 44, and thus the host platform 12, and second, to provide indexing positions for the assembly such that the slider may be set at, and locked into, various predetermined positions, which in turn, sets the overall length of the weapon/weapon platform.

It is particularly advantageous to have a discrete and separate keyway 42 (i.e., rib 40) apart from the shoulder stock 44 in the subject collapsible stock assembly or system 30. By reversibly uniting these elements, the shoulder stock 44 of the assembly of the invention may be integrated, or generally equipped with a wide variety of sliding buttstocks 34, for example, those of different length and/or varied style, as well as those incorporating specific, unique features. The keyway 42 may be configured so as to be square, rectangular or rounded on top to match the design of the buttstock, with the keyway 42 readily made to accept a variety of indexing devices as incorporated into the buttstock beyond that which is specifically illustrated.

As should be readily appreciated, the interchangeability of keyways allows users to have keyway detent positions custom made or configured for their particular physicality and/or application. This permits users with a range of arm-lengths to hold the host platform comfortably against their shoulder regardless of the length of their arms, or the type or amount of clothing, load-bearing, or protective gear being worn at the time in the shoulder area. Furthermore, the keyways may be changed as young users grow, allowing the existing stock and slider combination to match the user exactly. The subject arrangement also enhances the resale value of the stock combined with the host platform as user modifications are easily reversed by a new owner.

With regard to the alignment functionality of the subject invention, the interface of the shoulder stock 44 and the locking hinge 36, more particularly, the first linkage portion 46, is also depicted in FIG. 10. As previously noted, a wide variety of adaptations are contemplated in furtherance of securing each of the linkage portions 46, 48 to its host rail or stock, either directly, or indirectly. Be that as it may, it is especially advantageous to provide an interface for the shoulder stock 44 and linkage 36 which permits a selective, axial locked position for the shoulder stock assembly 32 relative to the linkage 36, as for instance via a threaded engagement wherein the threading is keyed around its diameter, and a set screw 118 secures the axial alignment of the shoulder stock assembly 32. With such arrangement, a user can adjust, and lock in the angle at which the sliding buttstock contacts their shoulder, allowing a more individual, comfortable fit that can be easily changed or used with other styles of sliding buttstocks.

There are other variations of the subject invention, some of which will become obvious to those skilled in the art. It will be understood that this disclosure, in many respects, is only illustrative. Changes may be made in details, particularly in matters of shape, size, material, and arrangement of parts, as the case may be, without exceeding the scope of the invention. Accordingly, the scope of the subject invention is as defined in the language of the appended claims.

What is claimed is:

1. A firearm stock assembly comprising a hinge pin, and first and second operatively linked hinge portions, said second hinge portion biasingly received upon said hinge pin, translation of said second hinge portion upon said hinge pin permitting rotation thereof between first and second interference arrangements for said first and second hinge portions, said first interference arrangement characterized by a first interference resistance, said second interference arrangement characterized by a second interference resistance, said first interference resistance being less than said second interference resistance.

2. A firearm stock assembly comprising a hinge pin, and first and second operatively linked hinge portions, said second hinge portion biasingly supported upon said hinge pin in furtherance of self registration of select elements of said first and second hinge portions, translation of said second hinge portion upon said hinge pin overcoming a self registration of select elements of said first and second hinge portions so as to thereby permit rotation of said second hinge portion about said hinge pin.

3. The assembly of claim 2 further comprising a shoulder stock extending from said second hinge portion.

4. The assembly of claim 2 further comprising a variably positionable shoulder stock extending and extendable from said second hinge portion.

5. The assembly of claim 2 wherein self registration of select elements of said first and second hinge portions comprises a first self registration of first select elements of said first and second hinge portions and a second self registration of second select elements of said first and second hinge portions.

6. The assembly of claim 2 wherein self registration of select elements of said first and second hinge portions prohibits rotation of said second hinge portion about said hinge pin.

7. The assembly of claim 6 wherein self registration of select elements of said first and second hinge portions comprises a latched interface of a latch of said second hinge portion and a latch receiving structure of said first hinge portion.

8. The assembly of claim 2 wherein self registration of select elements of said first and second hinge portions impedes rotation of said second hinge portion about said hinge pin.

9. The assembly of claim 8 wherein self registration of select elements of said first and second hinge portions comprises a hindered interface of a block of said second hinge portion and a stage of said first hinge portion.

10. The assembly of claim 2 wherein said self registration of select elements of said first and second hinge portions comprises a latched registration.

11. The assembly of claim 2 wherein rotation of said second hinge portion upon said hinge pin via grasping a free end portion of the assembly alters a further self registration of select elements of said first and second hinge portions in furtherance of uniting said first and second hinge portions.

* * * * *